US005749555A

United States Patent [19]

Albrecht

[11] Patent Number: 5,749,555

[45] Date of Patent: May 12, 1998

[54] HEIGHT COMPENSATING DEVICE

[75] Inventor: Donald H. Albrecht, Carrollton, Tex.

[73] Assignee: Composite Structures International, Inc., Dallas, Tex.

[21] Appl. No.: 512,879

[22] Filed: Aug. 9, 1995

[51] Int. Cl.[6] ..... A47C 3/04

[52] U.S. Cl. ..... 248/346; 108/53.3; 108/901; 482/52; D6/349

[58] Field of Search ..... 248/346.01, 346.02; 108/12, 91, 901, 53.3; 297/423.41, 423.39; 482/52; D6/349, 350, 364, 365; D21/191; 52/177, 180, 181

[56] References Cited

U.S. PATENT DOCUMENTS

| | | | |
|---|---|---|---|
| D. 157,319 | 2/1950 | Bair . | |
| D. 268,796 | 5/1983 | Kola | D6/349 |
| D. 337,211 | 7/1993 | Bergkuist | D6/349 |
| D. 344,858 | 3/1994 | Leduc | D6/349 |
| D. 346,704 | 5/1994 | Grosfillex . | |
| D. 347,527 | 6/1994 | Breen et al. . | |
| D. 355,988 | 3/1995 | Brooking | D6/344 X |
| D. 360,767 | 8/1995 | Fish et al. . | |
| D. 367,787 | 3/1996 | Vanskiver et al. . | |
| 4,950,033 | 8/1990 | Anderson . | |
| 5,127,647 | 7/1992 | Wilkenson | 482/52 |
| 5,176,596 | 1/1993 | Ullman | 482/52 |
| 5,354,247 | 10/1994 | Wikenson | 482/52 |
| 5,472,390 | 12/1995 | Faye | 482/52 |
| 5,536,072 | 7/1996 | Chang | 482/52 X |

*Primary Examiner*—Robert Canfield
*Attorney, Agent, or Firm*—Calfee, Halter & Griswold LLP

[57] ABSTRACT

A height compensating device made from a non-toxic material defining a support surface of a predetermined shape and having a periphery with a sidewall extending downwardly and outwardly from said sidewall. The surface of the support surface is roughened to the roughness of a quartz number 4 grit or greater. The structure has a weight of 8 pounds or greater.

27 Claims, 3 Drawing Sheets

HEIGHT COMPENSATING DEVICE

TECHNICAL FIELD OF THE INVENTION

The present invention relates to devices to elevate and support workers. In particular, the invention is a height compensating device useful in many assembly line factories but particularly adapted for use in food processing facilities.

BACKGROUND OF THE INVENTION

In processing facilities which process animals, poultry, fish, vegetable and other foodstuffs there is normally a great deal of manual labor. While the invention is useful in other similar assembly line environments, it will be described in relation to the food processing industry. Typically, a food processing line will be established with workers at individual stations performing various tasks in the processing of these food stuffs. These processing lines are typically constructed for the average height worker. People less than average height, while working at the facilities, are often required to reach up to perform their various tasks. This may lead to a number of difficulties for these individuals, such as reduced ability to see the work, fatigue by being required to hold their arms up in less than natural fashion and additional strain by being at an awkward position for lifting and moving the items they are working on, resulting in reduced efficiency and increasing the potential for accidents.

In the past, many of these individuals have adopted make-shift supports on which to stand while they work. These make-shift supports elevate them such that their arms and hands are in a more natural position while working. This minimizes fatigue and makes their work easier. Unfortunately, these make-shift platforms were devised from materials readily at hand, such as boxes or scrap grating. Such improvised solutions created their own problems in that they could easily slide on the floor, thus causing an accident, and not easily stored and may be made from a material not desirable in a food processing environment.

Thus, there has been a need to provide industry and, in particular, the food processing industry a height compensating device. The device of the present invention has numerous advantages including: made from non-toxic materials, made of non-porous material, easily cleaned and disinfected, easily stored in a minimum amount of space, resistant to slippage on the floor, resistant to skidding or slippage of the feet, non-corrosive, non-conductive, colorfast, durable and portable.

SUMMARY OF THE INVENTION

In one aspect the present invention relates to a height compensating device having a support surface of a predetermined shape with sidewalls extending downwardly and outwardly from said support, and having a weight of 8 pounds or more. In a preferred embodiment, the sidewall extends downwardly and outwardly at an angle between 5 to 25 degrees.

In another aspect the present invention relates to a height compensating device having a support surface defining a predetermined shape having a periphery, and a sidewall extending downwardly and outwardly from said surface at an angle of from 8 to 14 degrees, and said sidewall extending no more than 35% of the longest dimension of said support surface. The support surface is provided with a multitude of protrusions have a grit size adequate to provide a slip resistant surface for the worker to stand upon, and preferably, the protrusions are the size of number 4 quartz grit or larger, and the device has a weight of 8 to about 30 pounds.

In another aspect the invention relates to a height compensating device having a support surface, and a sidewall extending downwardly and outwardly from the surface at an angle of 8 to 14 degrees. The device includes the provisions of a drainage means for draining fluids from the support surface.

BRIEF DESCRIPTION OF THE DRAWINGS

The invention will better be understood by reference to the below drawings taken in conjunction with the following detailed description. The illustration of certain preferred embodiments of the invention are not intended to be limiting, but merely illustrative.

DETAILED DESCRIPTION

Figure 1:
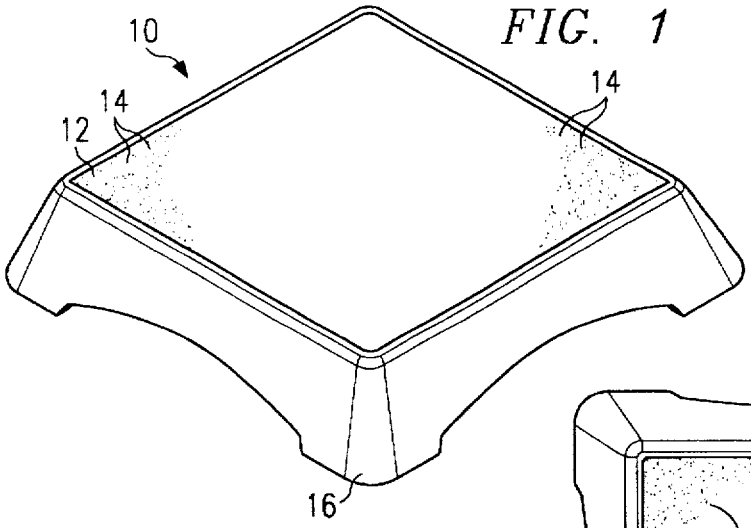
FIG. 1 is an isometric view of one embodiment of the invention.
Figure 2A:
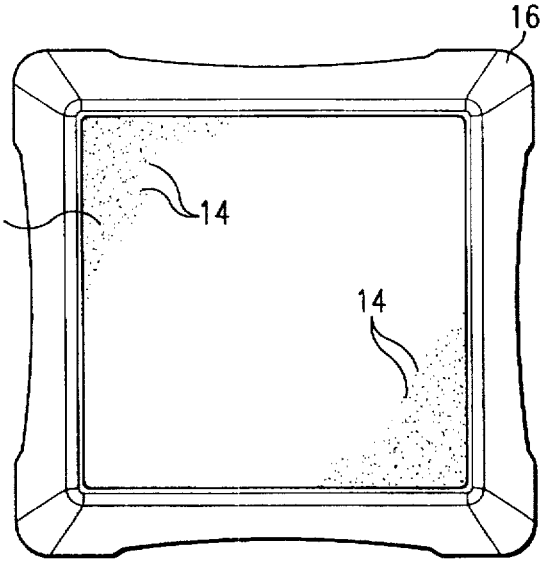
FIG. 2A is a top view of one embodiment of the present invention.
Figure 2B:
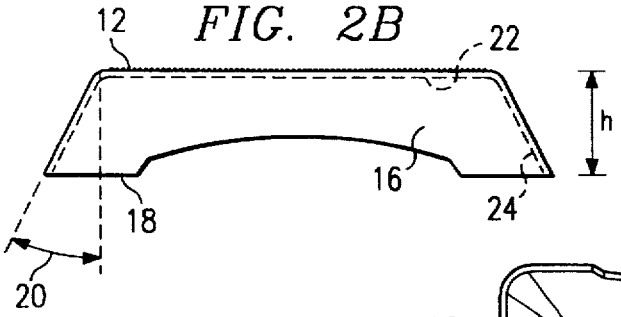
FIG. 2B is a side view of the device of the FIG. 2A.
Figure 2C:
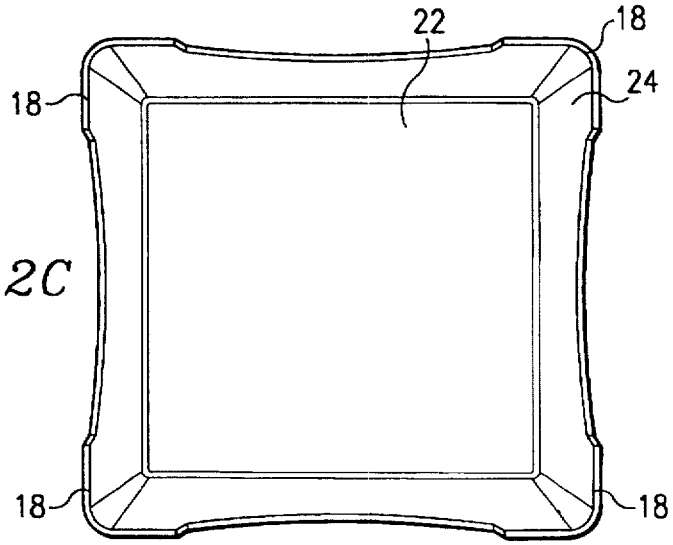
FIG. 2C is a bottom view of a FIG. 2A.

Referring to FIG. 2A, a top view of one embodiment of the present invention is shown, the device 10 has a support surface 12 of predetermined shape. The embodiment shown in FIGS. 2A–C is shown in isometric view in FIG. 1. The support surface 12 is the surface upon which the worker will stand. As illustrated in FIG. 2A, the support surface 12 can be a square shape. However, any shape may be utilized, and may be varied to meet particular requirements of different work locations. The size of the support surface 12 should be such that the worker may stand upon the surface with their feet spread in a natural, comfortable position about the width of their shoulders. In the preferred embodiment, the shape of the support surface is a square, each side of which is 18 inches or longer on each side. The upper side of the support surface also has a rough surface with many protrusions 14 which provide a rough surface that is skid resistant. In food processing facilities, there is usually much blood, body fluids, tissue, body parts, spray solutions, etc. which can make a surface slippery. The protrusions should be of a grit size to provide slip resistance in the intended use so that the worker's feet will be less likely to slip. In the food processing industry, where body fluid, fat and blood exist, a large grit is preferred. In the preferred embodiment the surface has protrusions with roughness of a number 4 quartz grit or larger.

Extending downwardly from support surface 12 and outwardly from support surface 12 is a sidewall portion 16. Sidewall portion 16 holds the support surface off the floor, a predetermined distance. Preferably the invention will be made such that a number of different heights will be made available so that individuals can select a height most convenient for them. In the preferred embodiments, various heights to be utilized would be 2 inches and greater. Also, it is preferred that the height of the sidewall not exceed 35% of the longest dimension of support surface 12. For example, if support surface 12 were a square 18 inches, on a side the longest dimension would be the diagonal of about 34.5 inches. Thus, the sidewalls should be less than about 8.9 inches. This minimizes tipping of the device when the worker shifts his weight.

Referring now to FIG. 2B, the side view of the device shown in FIG. 2A is illustrated (like numbers in like figures refer to like items). The height of the sidewall 16 is that distance which is perpendicular to the plane of the support surface 12 to the lower edge 18 of sidewall 16. The sidewall 16 slopes downwardly and outwardly from support surface 12, at an angle 20 from a perpendicular line extending from the plane of the support surface 12. Angle 20 serves several purposes. One to improve resistance of the device to tipping of the device as the worker shifts his weight and to improve resistance to sliding on the floor. Another purpose of angle 20 is that it allows similar devices to be stacked one upon another so that a minimum of space is taken up by the stacked devices. Angle 20 is from about 5 to about 25 degrees. Preferably, angle 20 is from 8 to 14 degrees.

Shown in phantom is the lower surface 22 of support surface 12 and the inter surface 24 of sidewall 16. The thickness of support surface 12 and sidewalls 16 depends upon the material of construction and the manner of construction. Preferably the construction of the device tends to be such that support surface 12 does not deflect more than about 0.75 inches under a concentrated load of 750 pounds applied to a square inch area. Preferably the support surface exhibits some flex to make it more comfortable to stand on for long periods but not so much flex that it disrupts the works's balance.

In the preferred embodiment, sidewall 16 has at least three lower edge sections to provide stability. The device may have one continuous lower edge 18 all in the same plane. However, by segmenting the lower edge 18, the device is more readily positioned on rough floors in a manner in which contact is made with the floor such that rocking caused by contact with an uneven floor is minimized. This allows the device to firmly contact with the floor.

Figure 3:
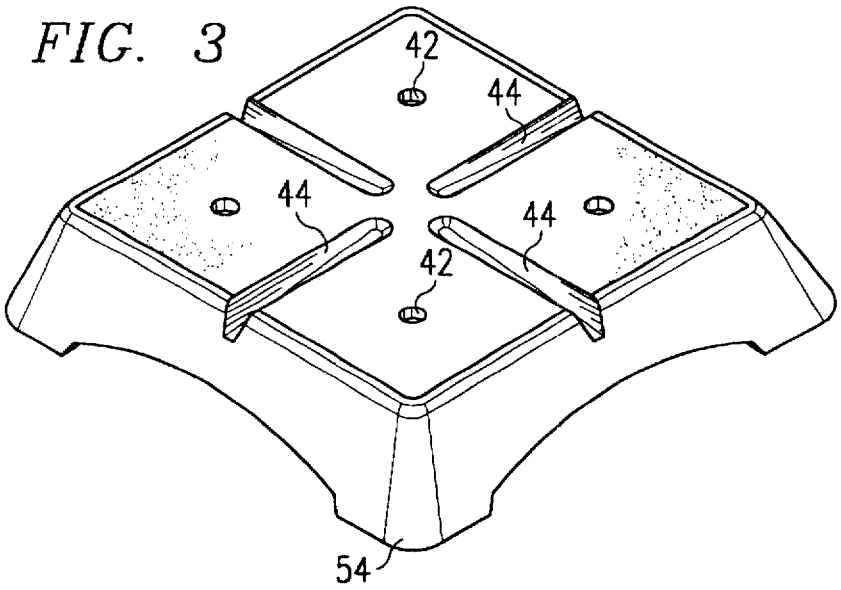
FIG. 3 is an isometric view of another embodiment of the invention.
Figure 4A:
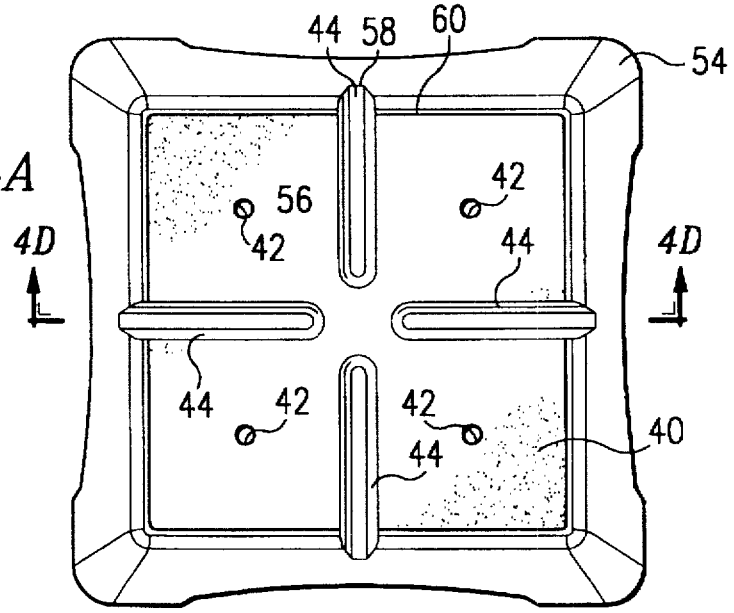
FIG. 4A is a top view of another embodiment of the present invention.
Figure 4B:
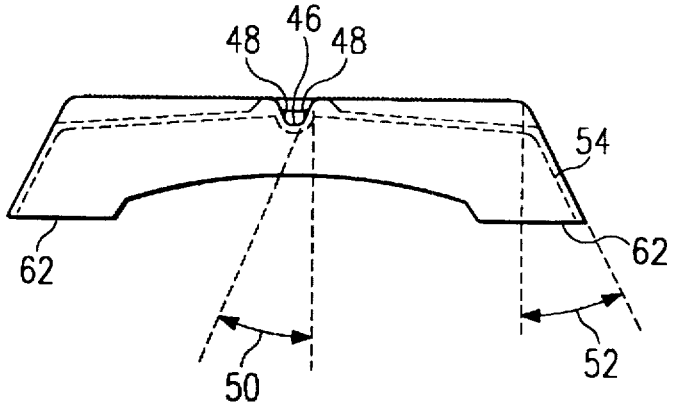
FIG. 4B is a side view of another embodiment of the FIG. 4A.

FIG. 3 is an isometric view of another embodiment of the present invention shown in FIGS. 4A–D. FIG. 4A shows a top view of another embodiment of the present invention. The device in FIG. 4A has a support platform 40. Support platform 40 can define one or more passageways 42 extending through platform 12. These passageways permit blood and other fluids to drain off support surface 12. Support surface 12 can also be provided with one or more drain channels 44 extending downwardly and outwardly towards the periphery of support surface 12. These channels can be provided in addition to passageways 42 or as an alternative to passageway 42. Also the device can be constructed with passageways but not drain channels. As shown in FIG. 2B, channels 44 have a bottom 46 and two side walls 48. Preferably the sides 48 of channels 44 are formed at an angle 50 which is the same or similar to that of the angle 52 of the sidewall 54. Sidewall 54 extends downwardly and outwardly from support surface 40. This permits stacking of the structures as described above.

Figure 4C:
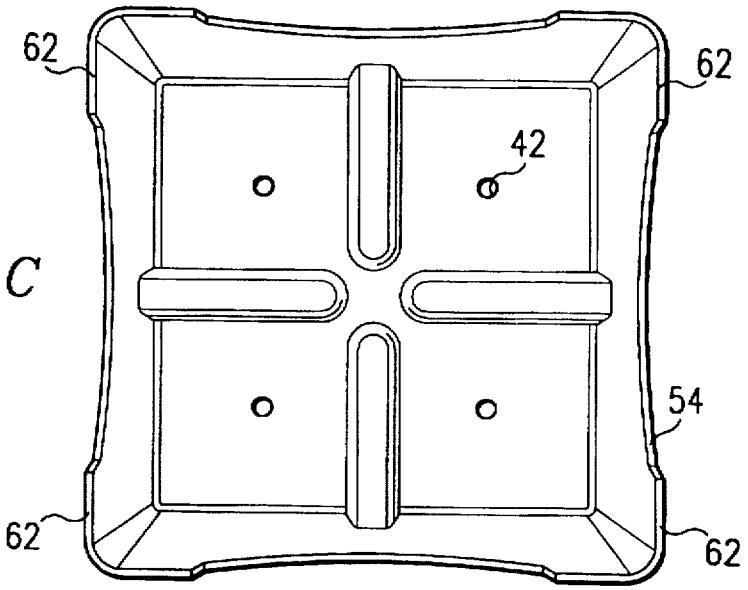
FIG. 4C is a bottom view of FIG. 4A.
Figure 4D:
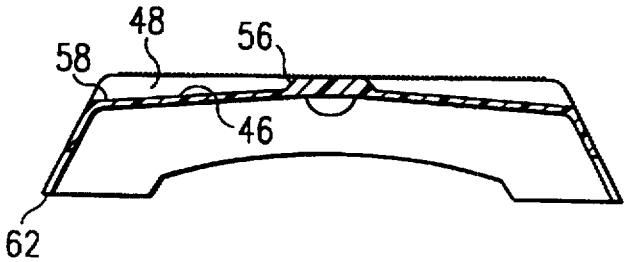
FIG. 4D is a cross-sectional view along line D—D of FIG. 4A.

Channels 44 have a first end 56 disposed a distance from the periphery 60 of support surface 40. (Shown in FIG. 4A) The second end of the channel 56 is at the periphery 60 of support surface 40 and intersects sidewalls 54. Preferably there is a downward slope from the first end to said second end of the channel 44. In this way a drain is formed by the channel to drain away blood and other fluids from the support surface 40. FIG. 4C is a bottom view of FIG. 4A. The device preferably has three or more lower edge sections 62 for making contact with the floor. If desired, lower edge 62 can be a continuous edge all in same plane. FIG. 4D shows a cross-section of the support structure shown in FIG. 4A along line D—D. FIG. 4D illustrates the downward slope of channel 44 and its intersection with the sidewall 54. Bottom 46 of channel 44 slopes downwardly from its first end 56 to the second end 58. The degree of the slope is one which allows liquid to drain away.

The present invention is preferably constructed from a polymeric resin which is non-toxic. Also it is preferred that the device be non-porous. Non-toxic as used in this application, means non-toxic as defined by the EPA (Environmental Protection Agency). Preferably all components used to construct the device are components which have either previously been approved by the USDA (United States Department of Agriculture) or which satisfy USDA requirements for products utilized in food processing facilities. Most preferably, the device is constructed from a composite of fiberglass reinforcement and an USDA accepted thermoset resin. A preferred resin is an isophtalic resin. Alternatively, the device can be of other non-toxic, non porous polymeric material. The device can be made without reinforcement material. However, use of a reinforcing material such as fiberglass mat, fiberglass fibers, carbon fibers, or other non-toxic reinforcing material is used. Preferably, the composition includes aluminum trihydrate as a flame retardant and a self extinguishing agent. The suitable self-extinguishing and flame retardant agent is preferably also non-toxic such as aluminum trihydrate. The materials selected for construction should be nontoxic to prevent contamination. The surface should be non-porous so as to not to provide growth areas for bacteria. Also, the device should be able to withstand caustics and temperatures used to disinfect work areas.

The device of the present is constructed such that it has a weight of 8 pounds or more, and preferably between 12 pounds to 30 pounds. The weight of the unit is important in that it should be sufficient to provide resistance to slipping on the floor, but the unit should be light enough so as to be transportable by the worker. To provide the rough surface on the support surface, one may utilize a suitable non-toxic grit of adequate size to provide a slip resistance surface in the intended use environment. A quartz number 4 grit or comparable grit of the same size or larger has been found useful for food processing applications. This provides a surface upon which the worker may stand which resists skidding and slippage of the shoes upon the surface.

In the preferred embodiment, the device is constructed in a unitary form. This eliminates the need for use of fasteners and the ridges and grooves normally associated with a product constructed in two or more pieces. Use of fasteners or a device which has ridges and grooves associated with a multi-piece product is undesirable because the normal fastener screws, etc. are subject to corrosion. Additionally, the holes, ridges and grooves associated with a multi-piece produce provide areas where bacteria can grow and multiply. Thus, preferably the unit is a one-piece product.

Most food processing facilities employ caustic wash to clean up the area and to disinfect the food processing area. The present invention and the preferred embodiment is a one-piece product made of non-corrosive materials which may be steamed cleaned with caustic wash and not be significantly degraded by the cleaning and sterilization process.

While the present invention has been described in terms of the preferred embodiments, those skilled in the art will recognize variations may be made keeping with the spirit of the invention.

What is claimed is:

1. A height compensating device comprising:

(a) a support surface defining a predetermined shape;

(b) a sidewall extending downwardly and outwardly from said support surface;

(c) said device having a weight of 8 pounds or more and having a non-porous surface; and (d) at least one sloped channel formed in said support surface and positioned to drain fluid.

2. The device of claim 1 wherein said sidewall extends downwardly and outwardly from the support surface at an angle of between 5 to 25 degrees as measured from the line running perpendicular to the plane of said support surface.

3. The device of claim 2 further comprising a plurality of protrusions extending from the side of the support surface opposite the side wall to provide a slip-resistant surface.

4. The device of claim 3 wherein said device is made from a non-toxic thermoset resin.

5. The device of claim 1 further comprising a plurality of channels.

6. The device of claim 1 wherein said channel has a first end, a second end, a bottom, and two opposed side walls forming an angle with respect to each other; and said channel being downwardly sloped from said first end to said second end.

7. The device of claim 5 wherein each of said channels has a first end, a second end, a bottom, and two opposed side walls forming an angle with respect to each other; and each of said channels being downwardly sloped from said first end to said second end.

8. The device of claim 6 each said first end is disposed near the center of said support surface and said second end intersects said sidewall.

9. The device of claim 1 wherein said device is an integral structure.

10. A height compensating device comprising:

(a) a support surface defining a predetermined shape defining a periphery having an upper side, and a lower side;

(b) a side wall extending downwardly and outwardly from the periphery of said support surface at an angle from about 5 to about 25 degrees as measured by a line perpendicular to the plane of the support surface;

(c) said device having a weight between about 8 and about 30 pounds;

(d) a plurality of protrusions extending from the upper side of said support surface to provide a slip resistant surface; and (e) said support surface having a plurality of holes for draining fluids.

11. The device of claim 10 wherein said side wall extends downwardly and outwardly at an angle from 8 to 18 degrees.

12. The device of claim 11 wherein said device is constructed of non-toxic materials.

13. The device of claim 12 wherein said sidewall extends downwardly when measured along the line perpendicular to said support surface, a distance no more than 35% of the longest dimension of said support surface.

14. The device of claim 13 wherein said protrusions have the roughness of a number 4 quartz grit or larger.

15. The device of claim 10 wherein said device is constructed from a thermoset resin.

16. The device of claim 15 wherein said device is constructed from a thermoset resin reinforced with a fiberglass reinforcement material.

17. The device of claim 15 being constructed from a isophtalic resin.

18. The device of claim 17 wherein said isophtalic resin contains reinforcement material.

19. The device of claim 10 wherein said device is an integral structure.

20. The device of claim 10 wherein said support surface further comprises at least one channel positioned for draining fluid from said support surface.

21. The device of claim 10 wherein said support surface further comprises a plurality of channels.

22. The device of claim 20 wherein said channel has a first end, a second end, a bottom, and two opposed side walls forming an angle with respect to each other; and said channel having a downward slope from said first end to said second end.

23. The device of claim 21 wherein each said channel has a first end, a second end, a bottom, and two opposed side walls forming an angle with respect to each other; and each said channel having a downward slope from said first end to said second end.

24. The device of claim 23 wherein said second end of each channel is at the periphery of said support surface and intersecting said side walls; and said first end of each channel is disposed a distance from the periphery of said support surface.

25. The device of claim 24 wherein said first end is located at about a center of said support surface.

26. The device of claim 10 wherein said device is integrally constructed using a fiberglass reinforced isophtalic resin with aluminum trihydrate in a suitable amount for flame-retarding.

27. A stackable height compensating device for use in a food processing plant comprising:

a unitary structure free of fasteners and formed from a fiberglass reinforced isothpalic resin containing aluminum trihydrate for use as a flame retardant;

said structure having a support surface of predetermined shape defining a periphery with a sidewall extending downwardly and outwardly from said periphery a distance as measured from a line perpendicular to the plane of said support surface no more than 35% of the longest dimension of the support surface and having a weight of 8 pounds or more;

said sidewall forming an angle of between about 8 to about 14 degrees with said support surface as measured along a line perpendicular to the plane of said support surface;

said sidewall having at least three lower edge sections for stability;

said support surface further comprising a plurality of protrusions extending from an upper side of the support surface and having a roughness of a number 4 quartz grit or larger to provide a slip resistant surface;

said support surface further comprising one or more channels with each said channel having a first end, a second end, a bottom and two opposed side walls forming an angle with respect to each other;

said support surface further comprising a plurality of holes for draining fluids;

each said channel having a downward slope from said first end to said second end;

each second end of the channel is located at the intersection of the periphery of said support surface and said side walls; and said first end of each channel is located near the center of said support surface.

* * * * *